US008235583B2

(12) United States Patent
Seiler et al.

(10) Patent No.: US 8,235,583 B2
(45) Date of Patent: Aug. 7, 2012

(54) MIXING BLADE WITH REMOVABLE WEARING ELEMENT

(75) Inventors: Andreas Seiler, Tauberbischofsheim (DE); Wolfgang Wörner, Höpfingen-waldstetten (DE); Klaus Ahke, Wertheim (DE)

(73) Assignee: Maschinenfabrik Gustav Eirich GmbH & Co. KG, Hardheim (DE)

( * ) Notice: Subject to any disclaimer, the term of this patent is extended or adjusted under 35 U.S.C. 154(b) by 1036 days.

(21) Appl. No.: 11/912,162

(22) PCT Filed: Mar. 29, 2006

(86) PCT No.: PCT/EP2006/061131

§ 371 (c)(1),
(2), (4) Date: Oct. 22, 2007

(87) PCT Pub. No.: WO2006/111455

PCT Pub. Date: Oct. 26, 2006

(65) Prior Publication Data

US 2009/0219782 A1 Sep. 3, 2009

(30) Foreign Application Priority Data

Apr. 22, 2005 (DE) ..... 10 2005 019 010

(51) Int. Cl.
*B01F 7/16* (2006.01)

(52) U.S. Cl. ..... 366/343

(58) Field of Classification Search ..... 366/325.1, 366/342, 343

See application file for complete search history.

(56) References Cited

U.S. PATENT DOCUMENTS

| | | | | | |
|---|---|---|---|---|---|
| 306,536 | A | * | 10/1884 | Shafer | 416/219 R |
| 1,555,964 | A | * | 10/1925 | Guedel | 366/66 |
| 2,966,345 | A | * | 12/1960 | Ciabattari et al. | 261/87 |
| 3,195,869 | A | * | 7/1965 | Paine | 366/342 |
| 4,304,494 | A | * | 12/1981 | Lutz | 366/343 |
| 4,478,515 | A | * | 10/1984 | Tobin | 366/67 |
| 4,660,987 | A | * | 4/1987 | Robinson | 366/67 |
| 6,622,514 | B2 | * | 9/2003 | Kesig et al. | 62/381 |
| 6,705,554 | B1 | * | 3/2004 | Kolle | 241/46.11 |
| 2009/0021782 | A1 | * | 1/2009 | Morimoto | 358/1.15 |

FOREIGN PATENT DOCUMENTS

| | | |
|---|---|---|
| DE | 202004013332 | 1/2005 |
| EP | 1477218 | 11/2004 |
| NL | 7502240 | 8/1976 |

* cited by examiner

*Primary Examiner* — Tony G Soohoo
(74) *Attorney, Agent, or Firm* — Paul & Paul

(57) ABSTRACT

The invention relates to a mixing blade (6) consisting, of a base part (15) fixable to a shaft and a removable wearable element (12). The aim of said invention is to develop a more economical mixing blade. For this purpose, the wearable element (12) and the base part (15) overlap on at least 30% of the base part length and define different cross-sections of the mixing blade (6) in said area.

21 Claims, 3 Drawing Sheets

MIXING BLADE WITH REMOVABLE WEARING ELEMENT

Figure 1:
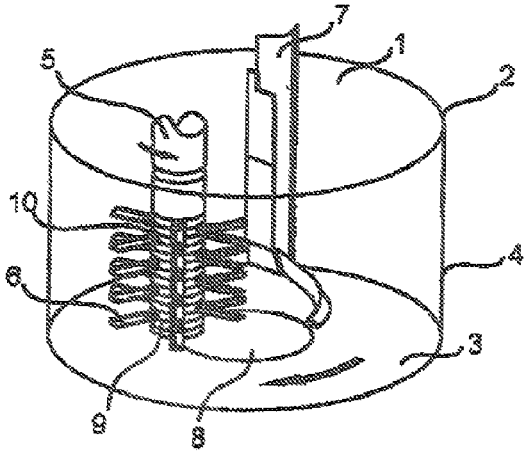

The present invention relates to a mixing blade comprising a base part fixable to a shaft and a removable wearing element.

A corresponding mixing blade is known from German Utility Model no. 203 07 420.3 and the corresponding EP 1 477 218 A. In the case of the known mixing blade, the tip of the mixing blade is formed as an interchangeable element and has a cross-section (perpendicular to the longitudinal direction of the mixing blade) matching the adjacent section of the mixing blade.

Mixing blades of this kind are provided for use in mixers in which grained, abrading materials are processed.

In the prior art, mixers are known which have one or more mixer shafts arranged perpendicular to the bottom of the mixing vessel, which shafts are provided with radially extending mixing blades arranged in several planes. In general the mixing blades are essentially of a rectangular cross-section, wherein this cross-sectional shape is sometimes also tapered towards the front edge of the mixing blade, so that the mixing blades have the shape overall of a flat, unilaterally rectangular trapezium. The front edge of the mixing blades is in this case the front edge in the direction of rotation of the corresponding rotor, which edge engages with the material to be mixed before the other parts of the mixing blade when the rotor is rotating. To achieve optimum mixing results, the front edge is often slanted in a knife-like manner, in order to give the processing material an axial movement component at the same time on penetration. The mixing blade base body generally comprises one piece and is manufactured from a comparatively soft material, such as for example structural steel. To protect against wear, the forward outer edges and the outermost end of the mixing blade as well as their immediate environment are protected by wear-resistant steel, a soldered-on hard metal plating or armouring. The armouring, preferably applied by build-up welding, can for example be made of a hard, wear-resistant coating, such as an alloy containing tungsten carbide. The thickness of the armouring is adjusted to the locally different wear effects acting on the mixing blade.

In the case of the known mixing blades, it is regarded as disadvantageous that these are frequently only interchangeable as a whole. The replacement of the wear-resistant coating or armouring is normally very laborious and cannot be carried out in the installed state. For refurbishing the mixing blades must therefore be completely dismantled.

From the above-named German Utility Model a mixing blade is already known on which solely the tip of the mixing blade can be exchanged separately from the remaining mixing blade, wherein it should be taken into consideration that precisely the tips of such mixing blades are among the most heavily wearing parts of a mixing blade due to the higher rotational speed.

Removable parts of mixing tools are also known from various other documents. DE 200 04 488 describes a mixer blade attached to a bracket protruding radially from a mixer shaft, in particular a bottom blade for concrete mixers, with removable blade tip.

As already mentioned, the mixing blades are loaded in an abrading manner in operation due to the material flows flowing over them at differing speed. In this process they are subject to wear of considerably differing intensity over the length and they wear preferably at their outer end, as the highest rotational speed prevails there. In the case of a rectangular cross-section slanted to the front in a knife-like manner, however, the forward edge is exposed to especially high wear in addition to the outer end of the mixing blade. This is especially true if coarse-grained products such as broken stone, for example, are contained in the mixture. When such coarse-grained constituents strike the front edge of the mixing tool, the narrower this edge is formed, the greater the mass of the individual coarse-grained constituents is and the harder these constituents are, the more the edge is stressed.

Due to the oblique face of the blade adjacent to the edge, the product is deflected accordingly upwards or downwards. The area of the cross-section adjacent to the bevel is considerably less affected by wear than the front edge including the bevelled faces. As soon as the armouring on the forward edge of the mixing blades is worn or removed, the soft base material located underneath is worn all the more easily and is subjected to very strong abrasion, which also encompasses areas of armouring still existing to some extent. This can lead to entire portions of the wear protection and the base body breaking out, which can lead to damage or even stoppages at downstream machines.

In operation, therefore, the complete mixing blades, which are normally fastened removably to the central mixer shaft, must be exchanged at regular intervals, even if only small parts of the mixing blade have been worn down to the base material and the wear protection is still sufficiently thick in other places.

A mixing blade with removable end piece only partially solves the problem, as it is entirely possible that occasionally even sections of the mixing blade lying radially inside the removable end piece have experienced heavier wear. In such a case the entire mixing blade nevertheless has to be exchanged. Furthermore, a gap can arise at the joint location due to permanent impact stress due to very coarse-grained products on the tip of the mixing blade, into which gap fine product jams and leads to elongation of the screw connection until it fails. Substantial elongation of the fixing means until they fail can occur also when using a removable end piece of solid carbide and very high rotational speeds, due to the great centrifugal forces on the mixing tool.

A marked extension of the end piece, which would include a perceptibly larger section of the mixing blade than just its tip, is likewise not a satisfactory solution to the problem, because then the saving on exchange of the end piece compared with a complete exchange of the mixing blade would only be relatively small.

Compared with this prior art, the object of the present invention is to create a mixing blade of the type stated at the outset which exhibits improved economy overall.

This object is achieved by a mixing blade which, in addition to the features stated at the outset, is characterized in that the wearing element (13) and the base part (15) overlap over at least 30% of the length of the base part and in this overlapping section define different areas of the cross-section of the mixing blade (6).

Here the length of the base part is measured from its radially inner end to be fixed on the shaft or corresponding bracket elements as far as the radially outer tip.

Due to the fact that the wearing element and the base part have different cross-sections and overlap in the longitudinal direction of the base part over a larger section of at least 30%, it is possible for one thing to exchange a larger section of the mixing blade without the entire remaining section of the mixing blade having to be removed or exchanged over its full cross-section.

According to the preferred embodiment, the wearing element forms at least the radially outer third, preferably at least the radially outer half of the front edge of the mixing blade in the running direction.

In this case the wearing element can form, in addition to the front edge, also the entire tip or the entire end piece of the mixing blade and thereby cover the cross-section of the tip of the base part either completely or at least partially.

This configuration makes it possible to exchange the worn parts of a mixing blade, to which the end piece and the radially outer half of the front edge normally belong, as required without the other parts, namely the base body of the mixing blade, also having to be exchanged. The exchange of the wearing elements can thus be restricted to the parts or areas that are actually exposed to increased wear and which apart from the end piece or the tip of the mixing blade also include its front edge at least in the radially outer 30% of the (radial) length of the mixing blade.

Here an embodiment in which the wearing element is formed in several parts, and comprises for example a front edge section and an end section or a tip of the mixing blade, which can be attached separately to the base part of the mixing blade, is particularly preferred.

According to a first embodiment, the wearing element has a rectangular shape in the top view and fills a correspondingly rectangular recess in the base part, wherein the corner areas are more or less strongly rounded (in part to avoid notch loads). In the top view, for example, the wearing element forms roughly the front half or the front third (measured respectively from the front edge) of the entire mixing blade, while the rear part of a mixing blade is formed by the base body, which can be made of a less hard material, but one which is easier to work.

Furthermore, an embodiment of the invention is preferred in which the cross-section of the wearing element is formed tapered towards the front edge. This knife-like formation with oblique leading faces contributes to particularly good mixing due to the vertical movement of the mixing material thereby produced, wherein the sharp front edges also ensure comminution of coarse-grained constituents or of agglomerates. However, sharp front edges here also means configurations in which the front edge of the mixing blade is not formed "razor-sharp" in the narrower sense, but rather the edge is markedly narrower than the maximum thickness of the mixing blade (measured in the direction of the axis of the related rotor), thus for example only comes to ¼ to 1/20 (or even less) of this thickness.

It is particularly preferred if the wearing element has the shape of a rectangular trapezium in cross-section, i.e. of a trapezium with one rectangular end and one end tapering at a relatively small angle, wherein the point defined thereby can also be somewhat bevelled or rounded off.

The connection between wearing element and base part is produced preferably via studs from the rear of the base part through holes in the base part, wherein the studs engage in threaded holes in the rear of the wearing element. The threaded holes can also be inserted or soldered-in threaded bushes.

According to an alternative embodiment, the wearing element defining the greatest part of the front edge has a cross-section decreasing from the tip of the blade in the direction of its radially inner end, while the base part has a correspondingly increasing cross-section in the same area. Here the cross-section decreases or increases essentially only in the direction of the width of the mixing blade, i.e. in the direction measured from the front edge towards the rear. With a cross-section decreasing continuously at the same rate, the shape of a right-angled triangle with one relatively acute angle for the wearing element then results in the top view from above. The end with the acute angle lies closer to the radially inner end of the mixing blade, i.e. towards the shaft. A still greater part of the harder and more expensive wearing material can be saved in this way, as the wear decreases more and more towards the radially inner sections of the mixing blade and less wearing material is needed there accordingly.

A modification of this, which is however based essentially on the same basic idea, is a shape which appears roughly Z-shaped in the top view or in which, starting out from the triangular shape just described, the two tips of the triangle (with angles smaller than 90°) are cut off. A further variant has approximately an L-shape, wherein the longer L-leg forming the front edge of the mixing blade widens continuously, however, in the direction of the second L-leg. A third modification of the triangular basic shape (narrower wearing body towards the middle, which becomes increasingly wider towards the outside) has a curved joint location, thus replaces the hypotenuse of the triangular shape initially described by a concave (or also convex) curve.

Figure 2:
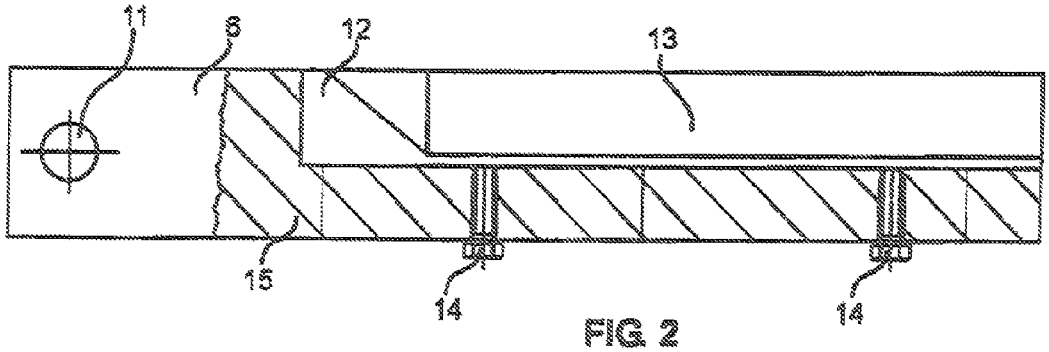
Figure 3:
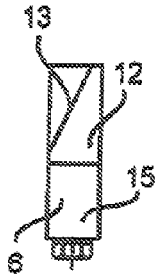
Figure 4:
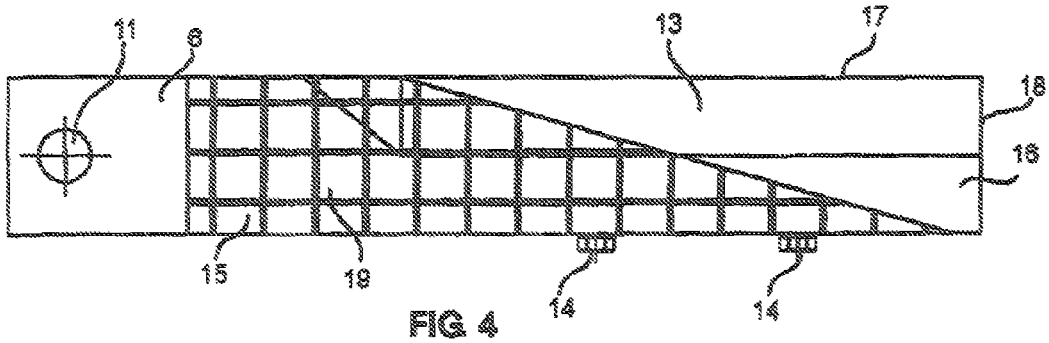
Figure 5:
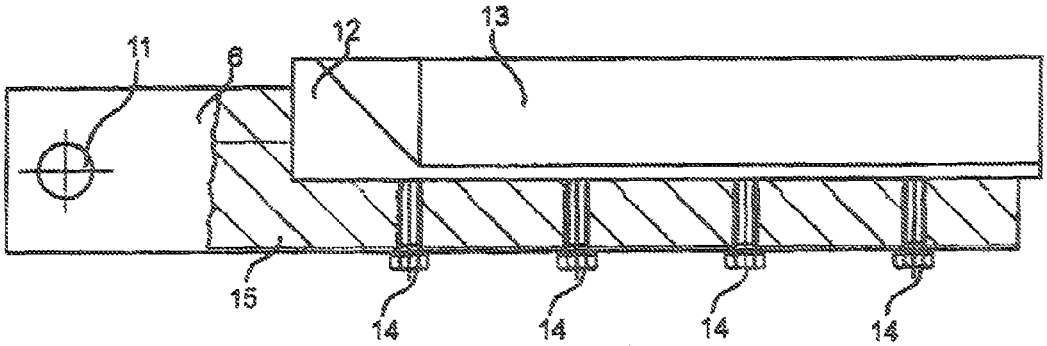
Figure 6:
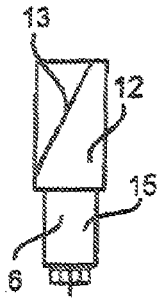
Figure 7:
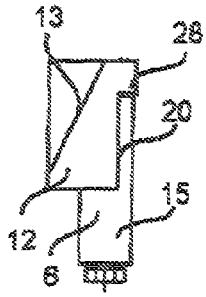
Figure 8:
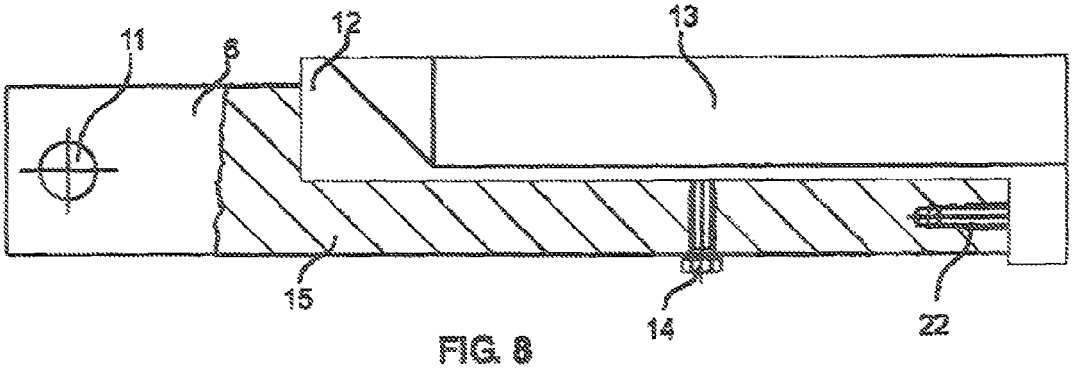
Figure 9:
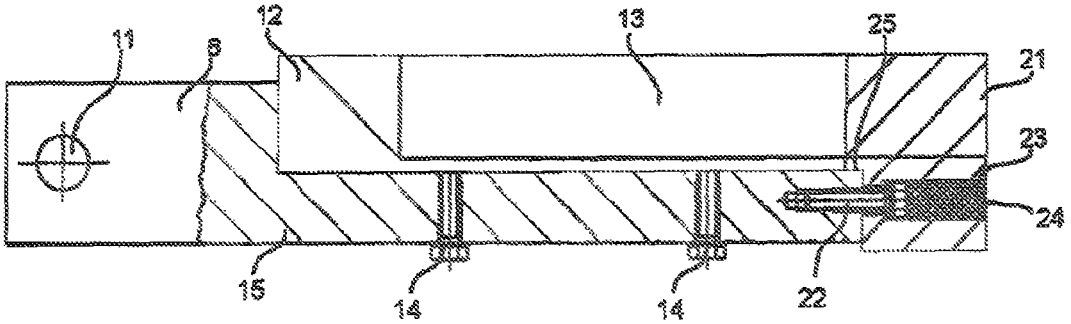
Figure 10:
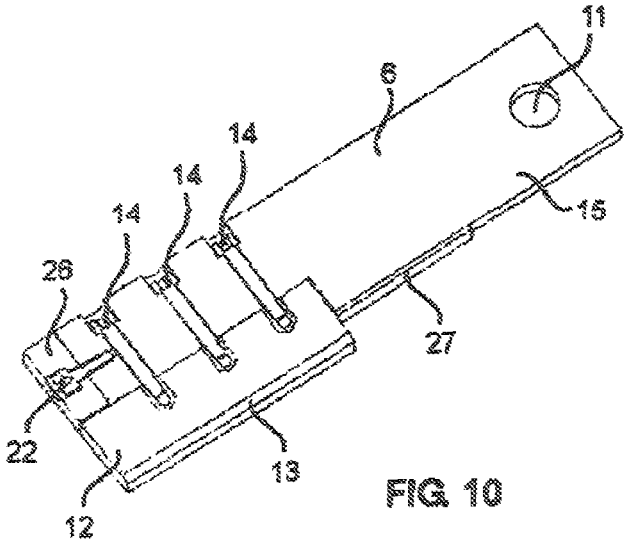

Further advantages, features and application options of the present invention result from the following description of preferred embodiments and the related figures. There are shown in:

FIG. 1 a rotating mixing vessel with eccentrically arranged mixer shaft and stationary wall-bottom scraper, FIG. 2 a top view of a mixing blade with removable wearing element, FIG. 3 a side view of a mixing blade with removable wearing element, FIG. 4 a top view of a mixing blade with removable triangular wearing element and hard metal plated base body, FIG. 5 a top view of a mixing blade with oversized removable wearing element, FIG. 6 a side view of a mixing blade with oversized wearing element, FIG. 7 a side view of a mixing blade with a wearing element adjacent to a flange, FIG. 8 a top view of a mixing blade with removable oversized L-shaped wearing element, FIG. 9 a top view of a mixing blade with removable wearing element and removable end piece, and FIG. 10 an isometric view of a cut-open mixing blade with removable wearing edge and removable corner piece.

FIG. 1 shows a mixer 1, which in the preferred embodiment is provided with a rotating mixing vessel 2, comprising a round, flat mixer base 3 and a cylindrical mixer wall 4. The mixer also has an overhung-mounted rotor 5 arranged eccentrically to the centre of the mixing vessel and extending to just above the mixer base, which rotor supports mixing blades 6 with a removable wearing element that extend radially and are arranged in several planes. The mixing vessel 2 and the rotor 5 are set in rotation via drives (not shown). The cylindrical wall 4 and the mixer base 3 are scraped by a stationary, combined wall-base tool 7. The mixing vessel 2 is emptied via the central bottom emptying opening 8.

The rotor 5 comprises a polygonal shaft (not shown), on which several tool holders 9 are arranged movably above one another. The mixing blades 6 are hooked in grooves 10 of the tool holders in pins (not shown) with the aid of the hole 11. The column of tool holders 10 with mixing blades 6 is braced for operation by a suitable removable connection. In an alternative embodiment, the mixing blades 6 are joined in one piece to the rotor 5. It is not absolutely necessary for the effectiveness of the invention that the mixing vessel 2 rotates and the rotor 5 is arranged eccentrically in the mixing vessel 2. In addition to the use of a stationary vessel 2, in which one or more rotors rotating about their vertical or inclined axis rotate in an orbit about a sun wheel arranged centrically to the centre of the mixing vessel, the rotor 5 can likewise be arranged with the mixing blades according to the invention centrically in a stationary mixing vessel. The mixing blade according to the invention could also be used radially from a rotor running horizontally which is arranged in a horizontal stationary mixing vessel.

The mixing blade 6 in FIG. 2 comprises a roughly L-shaped base body 15 with a rectangular recess, into which a corresponding, rectangular wearing element 12 is inserted to fit. Here too the corner of the wearing element lying inwardly in the joint area, like the corresponding corner of the recess, is preferably strongly rounded off. Thus the mixing blade has the shape of an oblong rectangle overall in the top view from above, wherein the greatest part of the front edge is defined up to roughly the longitudinal centre of the mixing blade 6 by the wearing element 12. The wearing element 12 has, as is recognized inter alia also in the front end view according to FIG. 3, the cross-section of a rectangular trapezium, the tip of which is capped somewhat, over the greater part of its length. Conversely, the wearing element could also be defined as a right parallelepiped, which on one side (optionally also on both sides) has a marked bevelling 13, so that a relatively narrow, knife-like front edge results for the wearing element, and the bevelling 13 forms a leading face for material to be mixed.

In FIG. 2 a transition area is recognizable towards the radially inner end in which the bevelling 13 becomes increasingly smaller, so that the cross-section of the wearing element 12 again assumes the shape of a rectangle at its inner end, supplementing the likewise rectangular cross-section of the base body 15 to give a longer, narrow rectangle. The inner end of the base part 15 has the same narrow rectangular cross-section, which is formed jointly by the wearing element 12 and the base part 15 (apart from the bevelling 13).

In the width of the mixing blade, the wearing element accounts for roughly 20% to 80%, preferably 30% to 70% and particularly preferably between 50% and 60% of the total width.

The removable wearing element 12 and the base body 15 of the mixing blade 6 are formed as separate components. As FIGS. 2 to 10 make clear, the components are connected detachably to one another by suitable fixing means. The connection must be able in this case to transfer the forces from the mixing material acting on the wearing element 12 to the base body 15 of the mixing blade 6. In addition, the wearing element 12 must be secured against torsion relative to the base body 15 of the mixing blade 6.

The detachable connection and securing against torsion can be achieved in various ways, for example by two or more screw connections 14 (FIG. 2), by one or more centering pins in combination with a screw connection or by an overlap of wearing element and base body of the mixing blade (FIG. 7, FIG. 8), as well as with at least one detachable connection element.

In the variant in FIG. 4, the removable wearing element has an essentially triangular shape in the top view from above. Here the triangular wearing element 12 in the top view has a width at the radially outer end 16 that corresponds to the overall width of the mixing blade 6, and tapers from there in the inward direction to a triangular point, which ends in this case at roughly 40% of the overall length of the mixing blade 6 (measured from its radially inner end).

This distribution of wearing material with a concentration of the material in the area of the tip and less and less wearing material towards parts lying further inwards radially largely corresponds to the actual wear characteristics in use, so that it can be assumed that after a certain time, if an exchange of the wearing element 13 is due, this exhibits uniform wear relative to the different quantity of wearing material at different radial positions over its entire length.

In FIG. 5, an embodiment is shown in which the rectangular wearing element 12 in the top view is oversized relative to the recess provided for this wearing element in the base body 15 of the mixing blade 6, i.e. it protrudes both in the forward direction and in a radial direction beyond the adjoining edges and faces of the base part 15. The rectangular wearing element 12 could alternatively also be made of several assembled rectangular or L-shaped parts.

As shown in FIG. 6, a corresponding wearing element 12 can also project in a vertical direction, i.e. in FIG. 5 perpendicular to the paper plane, beyond the adjacent faces of the base body 15, which leads as a result to the base body 15 being protected substantially better against the impact of mixing material and thus even better against wear than in the case of an embodiment such as described for example in connection with FIGS. 2 and 3.

In the embodiment according to FIG. 7, the recess provided for the wearing element 12 is designed as a rebate, so that in the lower area of the mixing blade base body 15 a flange 20 still remains, which serves as a bearing surface for the wearing element 12. Such an embodiment is particularly favourable if strong torques (with reference to the longitudinal axis of a mixing blade) act on the wearing element or the mixing blade 6. If the wearing element 12 is only fastened by studs, as shown by way of example in FIGS. 2 and 5, then in the case of such torques very strong forces also act on the stud connection. The flange 20 according to FIG. 7 takes up such torques without the fastening screws 14 being loaded excessively.

To protect the lower front edge of the flange 20 or the base body 15 against wear, the wearing element 12 has on its front edge a projection 28 protruding downwards, which covers the front edge of the flange 20.

If desired, the front edge of the wearing element 12 can nevertheless be designed likewise sharp or narrow as in the example of FIG. 6, in that the wearing element 12 is lengthened somewhat in its dimensions in the forward direction or in that the bevelling 13 is made a little deeper or slightly steeper.

In FIG. 8 a variant is shown in which the removable wearing element 12 has an L-shaped shape in the top view and thus a better support is realized through a greater overlap and a larger connection surface between base body 15 and wearing element 12. At the same time, the entire radially outer edge at the end of the mixing blade is protected against wear with the same wear protection material. In a fixing 22 of the short L-leg on the front end of the base part 15, this short L-leg also acts at the same time as an anti-twist device and relieves the pins 14 if torques act on the wearing element 12 or the bevelled surface 13 with reference to the longitudinal axis of the mixing blade 6.

A preferred embodiment of the invention is shown in FIG. 9. Here the removable wearing element 12 on the forward edge is combined with a removable end piece 21 designed as a separate component. The screw connection 22 of the end piece is carried out in an axial direction and is sunk as deep as possible in the end piece 21. The countersink 23 is closed by a suitable, removable filling 24. The end piece 21 is secured here against torsion (about the axis of the hole 23) by overlapping 25 with the base body 15 of the mixing blade 6. The removable wearing element 12 on the forward edge is inserted between base body and end piece 21.

A particularly preferred embodiment of the invention is shown by the isometric sectional view in FIG. 10. The removable wearing element 12 on the forward edge covers only a portion of the overall length of the base body 15 or of the mixing blade 6. The removable wearing element 12 is fastened from the trailing edge via several screw connections 14. A removable end piece 26 designed as a separate component is attached flush at the corner of the trailing edge of the base body 15. The screw connection 22 of the end piece 26 is carried out in an axial direction. The end piece 26 is secured against torsion in this case by supporting one edge on the removable wearing element 12. The base body 15 of the mixing blade 6 can, if not protected by the removable wearing element 12, 26, be protected against wear by non-removable wear protection 27 according to the prior art.

For purposes of the original disclosure it is pointed out that all features as they become apparent to a person skilled in the art from the present description, the drawings and the claims, even if described specifically only in connection with certain other features, can be combined both singly and in any combinations with other features or groups of features disclosed here unless this has been explicitly excluded or technical conditions make such combinations impossible or senseless. The comprehensive, explicit illustration of all conceivable combinations of features is dispensed with here only due to the brevity and readability of the description.

The invention claimed is:

1. A mixing blade (6) attachable to a rotatable shaft, the shaft having a center-axis, said mixing blade comprising a base part (15) fixable to the shaft and a removable wearing element (12), said base part having a base part length, characterized in that the wearing element (12) and the base part (15) overlap over at least 30% of the base part length, wherein the mixing blade is rectangular in a top view parallel to the center-axis of the shaft, wherein the base part has a rectangular recess in which the wearing element is inserted, wherein the wearing element has a wearing element length perpendicular to the center-axis of the shaft, and a majority of the wearing element length has a cross section in the shape of a right trapezoid, the cross section being perpendicular to the wearing element length and having an area, and wherein the wearing element has a transition area in which the area of the cross section increases towards the shaft along the wearing element length.

2. Mixing blade according to claim 1, characterized in that the mixing blade has a leading edge and the wearing element (12) encompasses at least one third of the leading edge of the mixing blade (6).

3. Mixing blade according to claim 2, wherein the wearing element has a top surface and a bottom surface and the mixing blade further comprising a flange projecting from the bottom surface of the wearing element adjacent to the leading edge.

4. Mixing blade according to claim 1, characterized in that the mixing blade has a leading edge and the wearing element (12) encompasses at least one half of the leading edge of the mixing blade (6).

5. Mixing blade according to one of claim 1, 2, or 4 characterized in that the wearing element (12) forms an entire end of the mixing blade (6) and covers a radial tip of the base part (15) at least partially.

6. Mixing blade according to one of claim 1, 2, or 4, wherein the base part has a projection in a radial, axial and circumferential direction.

7. Mixing blade according to one of claim 2 or 4, characterized in that the wearing element (12) is formed tapered towards the leading edge.

8. Mixing blade according to claim 7, wherein the cross section is in the shape of a truncated right trapezoid.

9. Mixing blade according to claim 8, wherein the wearing element has a top surface and a bottom surface and the mixing blade further comprising a flange projecting from the bottom surface of the wearing element adjacent to the leading edge.

10. Mixing blade according to one of claim 1, 2, or 4 characterized in that the wearing element is connected via studs (14) to the base part (15), which studs extend through holes in the base part (15) into threaded holes in the wearing element (12).

11. Mixing blade according to one of claim 1, 2, or 4, characterized in that the wearing element is made of a front edge section (12) and an end section (21, 26).

12. A mixing blade (6) attachable to a rotatable shaft having a center-axis, said mixing blade comprising a base part (15) fixable to the shaft and a removable wearing element (12), said base part having a base part length and said wearing element having a wearing element length perpendicular to the center-axis, characterized in that the wearing element (12) and the base part (15) overlap over at least 30% of the base part length, the mixing blade has a mixing blade length and a first cross-section that is perpendicular to the mixing blade length and the mixing blade has a transition area in which the area of the first cross section increases towards the shaft along the mixing blade length, and wherein the wearing element has a second cross-section that is perpendicular to the wearing element length and the area of the second cross-section decreases towards the shaft along the wearing element length.

13. Mixing blade according to claim 12, characterized in that the mixing blade has a leading edge and the wearing element (12) encompasses at least one third of the leading edge.

14. Mixing blade according to claim 13, characterized in that the wearing element (12) encompasses at least one half of the leading edge of the mixing blade (6).

15. Mixing blade according to any one of claim 12, 13, or 14, characterized in that the wearing element (12) forms an entire end of the mixing blade (6) and covers a radial tip of the base part (15) at least partially.

16. Mixing blade according to any one of claim 12, 13, or 14, characterized in that the mixing blade is rectangular in a top view parallel to the center-axis of the shaft.

17. Mixing blade according to any one of claim 13 or 14, characterized in that the wearing element (12) is formed tapered towards the leading edge.

18. Mixing blade according to any one of claim 12, 13, or 14, characterized in that the first cross-section is in the shape of a right trapezoid over a majority of the wearing element length.

19. Mixing blade according to claim 18, wherein the first cross-section is in the shape of a truncated right trapezoid.

20. Mixing blade according to any one of claim 12, 13, or 14 characterized in that the wearing element is connected via studs (14) to the base part (15), which studs extend through holes in the base part (15) into threaded holes in the wearing element (12).

21. Mixing blade according to any one of claim 13 or 14, wherein the wearing element has a top surface and a bottom surface and the mixing blade further comprising a flange projecting from the bottom surface of the wearing element adjacent to the leading edge.

* * * * *

UNITED STATES PATENT AND TRADEMARK OFFICE

CERTIFICATE OF CORRECTION

PATENT NO. : 8,235,583 B2
APPLICATION NO. : 11/912162
DATED : August 7, 2012
INVENTOR(S) : Andreas Seiler et al.

It is certified that error appears in the above-identified patent and that said Letters Patent is hereby corrected as shown below:

Column 7, line 61, Claim 5 reads "5. Mixing blade according to one of claim 1, 2, or 4 char-"
should read -- 5. Mixing blade according to one of claims 1, 2, or 4 char- --

Column 7, line 65, Claim 6 reads "6. Mixing blade acording to one of claim 1, 2, or 4,"
should read -- 6. Mixing blade according to one of claims 1, 2, or 4, --

Column 7, line 1, Claim 7 reads "7. Mixing blade according to one of claim 2 or 4, charac-"
should read -- 7. Mixing blade according to one of claims 2 or 4, charac- --

Column 8, line 10, Claim 10 reads "10. Mixing blade according to one of claim 1, 2, or 4"
should read -- 10. Mixing blade according to one of claims 1, 2 or 4 --

Column 8, line 15, Claim 11 reads "11. Mixing blade according to one of claim 1, 2, or 4"
should read -- 11. Mixing blade according to one of claims 1, 2, or 4 --

Column 8, line 40, Claim 15 reads "15. Mixing blade according to any one of claim 12, 13, or"
should read -- 15. Mixing blade according to any one of claims 12, 13, or --

Column 8, line 44, Claim 16 reads "16. Mixing blade according to any one of claim 12, 13, or"
should read -- 16. Mixing blade according to any one of claims 12, 13, or --

Column 8, line 47, Claim 17 reads "17. Mixing blade according to any one of claim 13 or 14,"
should read -- 17. Mixing blade according to any one of claims 13 or 14, --

Column 8, line 50, Claim 18 reads "18. Mixing blade acording to any one of claim 12, 13, or"
should read -- 18. Mixing blade according to any one of claims 12, 13, or --

Column 8, line 56, Claim 20 reads "20. Mixing blade according to any one of claim 12, 13, or"
should read -- 20. Mixing blade according to any one of claims 12, 13, or --

Signed and Sealed this
Second Day of October, 2012

David J. Kappos

David J. Kappos
*Director of the United States Patent and Trademark Office*

Column 8, line 61, Claim 21 reads "21. Mixing blade according to any one of claim 13 or 14,"
should read -- 21. Mixing blade according to any one of claims 13 or 14, --